US006085941A

United States Patent [19]

Pauser et al.

[11] Patent Number: 6,085,941

[45] Date of Patent: Jul. 11, 2000

[54] FILM TUBE FOR FLOWABLE SUBSTANCES

[75] Inventors: Helmut Pauser, Diessen; Gerd Brandhorst, Landsberg, both of Germany

[73] Assignee: Thera Patent GmbH & Co. KG, Seefeld, Germany

[21] Appl. No.: 08/796,845

[22] Filed: Feb. 5, 1997

[30] Foreign Application Priority Data

Feb. 7, 1996 [DE] Germany ..... 296 02 111 U

[51] Int. Cl.[7] ..... B65D 47/22; B67D 5/06

[52] U.S. Cl. ..... 222/92; 206/277; 222/103; 222/541.6; 383/71; 383/104; 383/222; 383/906; 428/35.2; 428/43

[58] Field of Search ..... 428/35.2, 43; 383/71, 383/78, 88, 89, 104, 120, 123, 124, 906, 222; 222/541.3, 541.4, 541.5, 541.6, 541.7, 541.8, 92, 103; 206/277

[56] References Cited

U.S. PATENT DOCUMENTS

| | | | |
|---|---|---|---|
| 3,141,221 | 7/1964 | Faulls, Jr. | 383/89 |
| 3,516,537 | 6/1970 | Dreyfus et al. | 206/46 |
| 5,035,348 | 7/1991 | Seifert | 222/107 |
| 5,286,105 | 2/1994 | Herold et al. | 366/177 |
| 5,480,067 | 1/1996 | Sedlmeier | 222/107 |
| 5,547,284 | 8/1996 | Imer | 383/104 |

FOREIGN PATENT DOCUMENTS

| | | |
|---|---|---|
| 0620165 A1 | 3/1994 | European Pat. Off. . |
| 0 620 165 | 10/1994 | European Pat. Off. . |
| 1 065 305 | 5/1954 | France . |
| 1 930 032 | 1/1970 | Germany . |
| 38 26 887 | 2/1990 | Germany . |
| 92 37 558 | 12/1992 | Germany . |
| 93 01 852 | 7/1993 | Germany . |
| 43 22 572 | 1/1995 | Germany . |
| 609614 | 4/1953 | United Kingdom . |
| 690614 | 4/1953 | United Kingdom . |

*Primary Examiner*—Ellis Robinson
*Assistant Examiner*—Sandra M. Nolan
*Attorney, Agent, or Firm*—Foley & Lardner

[57] ABSTRACT

In a film tube containing a flowable substance, a fold 11 is formed in the film, which fold is so shaped that it abruptly decreases the cross-section at this location of the tube. The fold 11 may be fixed by a V-shaped weld 12. When the film tube is compressed, maximum stress is exerted on the area of the film close to the apex 13 of the V-shaped weld 12, so that the tube starts to rupture and form a dispensing opening at this location.

3 Claims, 1 Drawing Sheet

FILM TUBE FOR FLOWABLE SUBSTANCES

BACKGROUND OF THE INVENTION

Film tubes having both ends closed by a clip are being increasingly used, due to their low material consumption, for packing flowable, specifically pasty, substances.

For emptying such a film tube, the tube is placed in a rigid container or cartridge which has a dispensing opening in the vicinity of one of the two tube ends.

In a device known from German Offenlegungsschrift No. 3,826,887, the film tube is punctured by a pin which is manually inserted through a dispensing pipe provided on a cartridge cap, whereupon the pin is retracted.

German Utility Model No. 9,103,038 discloses a device in which the cap of a cartridge receiving the film tube comprises a blade in the vicinity of a lateral dispensing opening, which blade serves to severe one of the folds formed at the front end of the film tube when pressure is exerted on the rear tube end.

German Offenlegungsschriften Nos. 4,322,572 and 1,930,032, British patent No. 690,614, French patent No. 1,065,365 and German Utility Model No. 9,207,558 disclose film tubes which have a nick, slit or similar means provided in a (usually welded) peripheral portion of the tube to enable the tube to be more easily torn or cut open manually. None of these documents is concerned with the possibility of opening the tube by increasing the interior pressure (such as by advancing a piston).

Similarly, European patent application, publication No. 0,620,165 describes a film tube in which the outermost layer of the tube film has a weakened portion for providing a rated breaking point. A dispensing means is provided with a spike for puncturing the tube film.

SUMMARY OF THE INVETNION

It is an object of the present invention to provide a film tube with inexpensive means to open up the tube at the time it is to be emptied.

The present invention meets this object by a film tube for a flowable substance, wherein the film constituting the tube is formed with a fold which abruptly decreases the cross-section of the tube. When pressure is applied, maximum stress within the film will occur at a location immediately adjacent the fold. Thus, when the film tube is to be emptied, which is normally done by a piston exerting pressure upon the rear end of the tube, the film will burst at the designed location of largest stress, i.e. directly within the fold.

The film tube of the invention thus requires no additional elements, such as blades or pins, to be provided on the dispensing means; instead, it is in itself formed with a rated breaking point. The invention may thus be realized in a simple and inexpensive way.

In a preferred embodiment, the fold forms an apex pointing toward the interior of the film tube, thus providing a very exact location of the rated breaking point.

If the fold is fixed by a weld, no additional element whatsoever is required. The weld has preferably a V-shape, which again results in a precise location of the rated breaking point. Further, it is advantageous to remove the film material from the gusset area of the V-shaped weld, which results in a dispensing opening forming automatically when the weld is torn open.

In another embodiment of the invention, the fold is fixed by a clamp which is applied externally on the film tube. The clamp is preferably made of metal and has two legs which are biased against each other and terminate in an apex disposed at a location pointing toward the interior of the film tube. In this embodiment, the film tube is easy to manufacture as the clamp may be applied in the same process step as a clip for closing the tube end. Also, an exact position of the rated breaking point is achieved.

The fold is preferably formed near an end of the film tube, which is of advantage in the practical use of the tube.

DETAILED DESCRIPTION OF PREFERRED EMBODIMENTS

Figure 1:
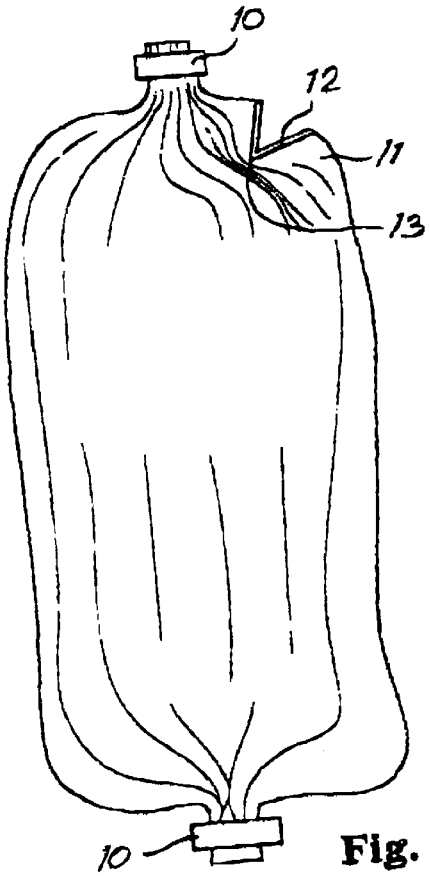
FIG. 1 is a side view of a film tube in accordance with a first embodiment of the invention.
Figure 1A:
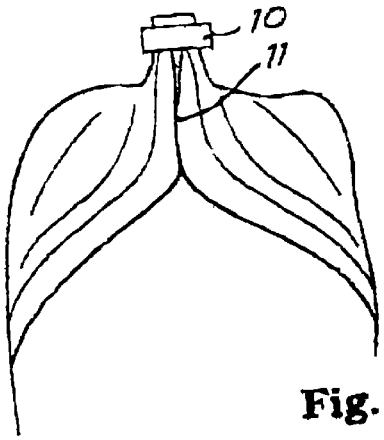
FIG. 1*a* shows the upper portion of the tube in a side view rotated 90° with respect to FIG. 1.

The film tube shown in FIGS. 1 and 1*a* is closed at either end by a metal clip 10. A fold 11 is formed in the tube film near one end of the tube and is fixed by a weld 12. The weld 12 is V-shaped with its apex 13 pointing toward the interior of the tube. The cross-section of the tube thus abruptly decreases at the location of the apex 13. The film material is removed from the gusset portion formed within the weld 12.

If the filled film tube is compressed, the stress in the film material becomes maximum at the location of the apex 13 so that the weld 12 will start to rupture at this point and enable the tube content to emerge through the opening that starts to form there.

When the film tube is used in an activating device such as known from German Utility Model No. 9,103,038, it is placed in a cartridge, which is part of the known activating device, in such a way that the fold 11 is placed in the area of a dispensing opening existing laterally in a cap of the cartridge. To ensure proper positioning of the fold 11 in the film tube relative to the dispensing opening in the cartridge, the cartridge cap may be glued to the front end of the tube to form a unit therewith.

Figure 2:
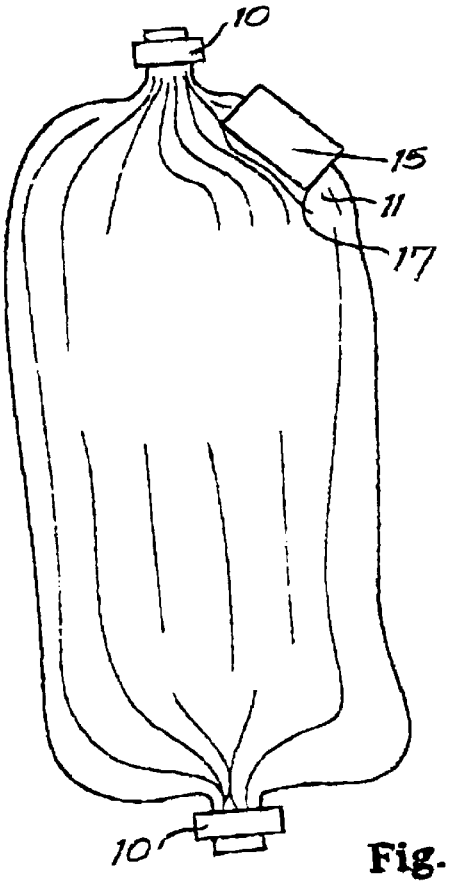
FIGS. 2 and 2*a* are views similar to FIGS. 1 and 1*a* of a film tube according to a second embodiment of the invention.
Figure 2A:
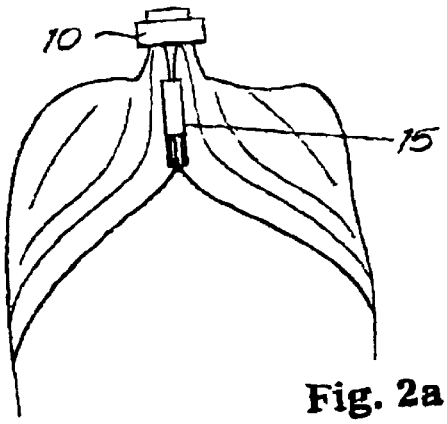

In the embodiment of FIGS. 2 and 2*a*, the fold 11 which is formed near the upper closing clip 10 is fixed by a metal clamp 15. The clamp 15 has generally a U-shape with a pair of rectangular legs which are biased against each other.

If the filled film tube is compressed, the maximum stress in the tube film will occur at the apex formed by the inner corner 17 of the clamp 15, and the tube will start to rupture at this point—similar as in FIG. 1.

Instead of the rectangular metal clamp 15 shown in FIG. 2, it may be preferred to use a clamp of a different shape, e.g. a triangular clamp, as long as it forms an apex pointing toward the interior of the film tube and causing the maximum stress to occur at this location.

What is claimed is:

1. A pressure rupturable container for a flowable substance comprising a clamp and a film tube, said tube having a fold designed to have a point at which the interior cross section of said tube is decreased abruptly, said point further designed as a point of breakage where said tube is ruptured as a result of an increase in its internal pressure, and wherein said fold is fixed by said clamp externally applied to said tube, said clamp defining an apex pointing toward the tube's interior as the only means defining said point of breakage.

2. The container of claim 1, wherein said clamp is a metal clamp having two legs biased against each other and terminating in said apex.

3. The container of claim 1, wherein said fold is formed near and end of said tube.

* * * * *